United States Patent [19]

Hou

[11] Patent Number: 4,890,828

[45] Date of Patent: Jan. 2, 1990

[54] ORNAMENTAL DISPLAY ASSEMBLY

[76] Inventor: Jack Hou, P.O. Box 78-95, Taipei, Taiwan

[21] Appl. No.: 329,330

[22] Filed: Mar. 27, 1989

[51] Int. Cl.[4] ..... A63H 13/20

[52] U.S. Cl. ..... 272/31 R; 446/238; 40/426; 40/428; 272/42; 272/44; 272/45; 272/47

[58] Field of Search ..... 272/31 R, 31 A, 31 B, 272/31 P, 28 R, 44, 36, 38–41, 45, 47; 446/237, 238, 409, 298, 303, 309, 299, 300–303, 332, 357, 358; 40/426, 428

[56] References Cited

U.S. PATENT DOCUMENTS

| | | | |
|---|---|---|---|
| 546,912 | 9/1895 | Boettcher | 272/31 R |
| 1,242,194 | 10/1917 | Jewell . | |
| 1,271,892 | 9/1918 | Habeshan . | |
| 2,061,695 | 11/1936 | Dalton . | |
| 2,457,447 | 12/1948 | Cohn . | |
| 2,506,214 | 5/1950 | Harman . | |
| 2,569,922 | 10/1951 | Centofanti . | |
| 2,715,530 | 8/1955 | Olsen . | |
| 2,846,223 | 8/1958 | Nelson | 272/31 R |
| 3,112,929 | 12/1963 | Gisser | 272/31 R |
| 3,191,930 | 6/1965 | Cottrell et al. . | |
| 3,279,793 | 10/1966 | Lakin . | |
| 3,498,603 | 3/1970 | Lakin . | |
| 4,753,436 | 6/1988 | Sinclair | 272/31 R |

FOREIGN PATENT DOCUMENTS

| | | |
|---|---|---|
| 352221 | 3/1961 | Switzerland . |
| 75206616 | 7/1986 | Taiwan . |

*Primary Examiner*—Richard E. Chilcot, Jr.
*Attorney, Agent, or Firm*—Bacon & Thomas

[57] ABSTRACT

A plurality of ornaments are supported on a base within which a wind-up music box mechanism is housed for imparting rotational movement to a first ornament in driving engagement with a wind-up shaft of the mechanism, and alternating vertical movements to second and third ornaments supported on tappet rods engaged by a pair of offset eccentric cam members mounted on a drive shaft driven by the mechanism.

15 Claims, 4 Drawing Sheets

3
1
5
4
11
13
9
13
7
17
3
56
56
25
19
23
21
25
3
4

ORNAMENTAL DISPLAY ASSEMBLY

BACKGROUND OF THE INVENTION

1. Field of the Invention

The present invention generally involves the field of technology pertaining to devices for imparting different movements to a plurality of ornaments while accompanying such movements with music. More specifically, the invention relates to an improved ornamental device wherein rotational and vertical movements are imparted to a plurality of ornaments by a wind up music box mechanism.

2. Description of the Prior Art

It is known to support an ornament, such as a toy whirligig, on a base containing a wind-up music box mechanism wherein the main spring of the mechanism both imparts movement to the ornament and produces accompanying musical sounds. The main spring is wound by rotating a shaft which extends downwardly from the base and is provided with a key or other appropriately configured member at its end for grasping by the user.

Devices of this type are often provided with plural ornaments formed from fragile material, such as ceramic, which may be easily broken and impart considerable weight to the device. It is therefore difficult to wind-up the music box mechanism of such a device since the device must be lifted and turned on its side in order to gain access to the wind-up key. This renders the device difficult to handle, especially by children, since considerable care must be exercised in preventing accidental breakage of the ornaments.

When a conventional device is provided with ceramic ornaments that include a canopy and a plurality of horses which revolve together during rotation of the canopy by the music box mechanism, a large amount of force must be exerted to rewind the main spring due to the weight of the ornaments. Moreover, the simple rotational movement imparted to the ornaments becomes less interesting and monotonous to observe after a short period of operation.

SUMMARY OF THE INVENTION

It is an object of the present invention to provide an improved device for imparting movement to one or more ornaments supported on a base.

It is another object of the invention to provide an improved ornamental display device wherein different movements are imparted to different ornaments by a wind-up drive mechanism.

It is a further object of the invention to provide an improved ornamental assembly wherein movements of fragile ornaments are imparted by a wind-up drive mechanism which is easy to wind up and minimizes the possibility of breaking the ornaments.

It is still another object of the invention to provide an improved ornamental assembly driven by a wind-up music box mechanism wherein different and varied movements are imparted to the ornaments while accompanied by music to produce a display that captures the interest of a viewer for a long period of time.

These and other objects of the invention are realized by providing an ornamental display assembly wherein a wind-up music box mechanism of the type containing a main spring is housed within a base. A stationary hollow sleeve extends upwardly from the base and houses a rotatable support rod, the lower end of the rod being threadedly engaged onto an upstanding end of a wind-up shaft for the main spring of the mechanism, and the upper end of the rod extending outwardly from the top of the sleeve for receiving a threaded handle which secures an ornament onto a resilient support member mounted on the end of the rod so that rotation of the ornament shall cause rotation of the rod and winding of the main spring. A horizontal drive shaft is also driven by the mechanism to rotate two offset eccentric cam members carried at opposite ends of the drive shaft for alternately raising and lowering a pair of corresponding tappet rods on which two additional ornaments are mounted.

Other objects, features and advantages of the invention shall become apparent from the following detailed description of preferred embodiments thereof, when taken in conjunction with the drawings wherein like reference characters refer to corresponding parts in the several views.

DETAILED DESCRIPTION OF THE PREFERRED EMBODIMENTS

Figure 1:
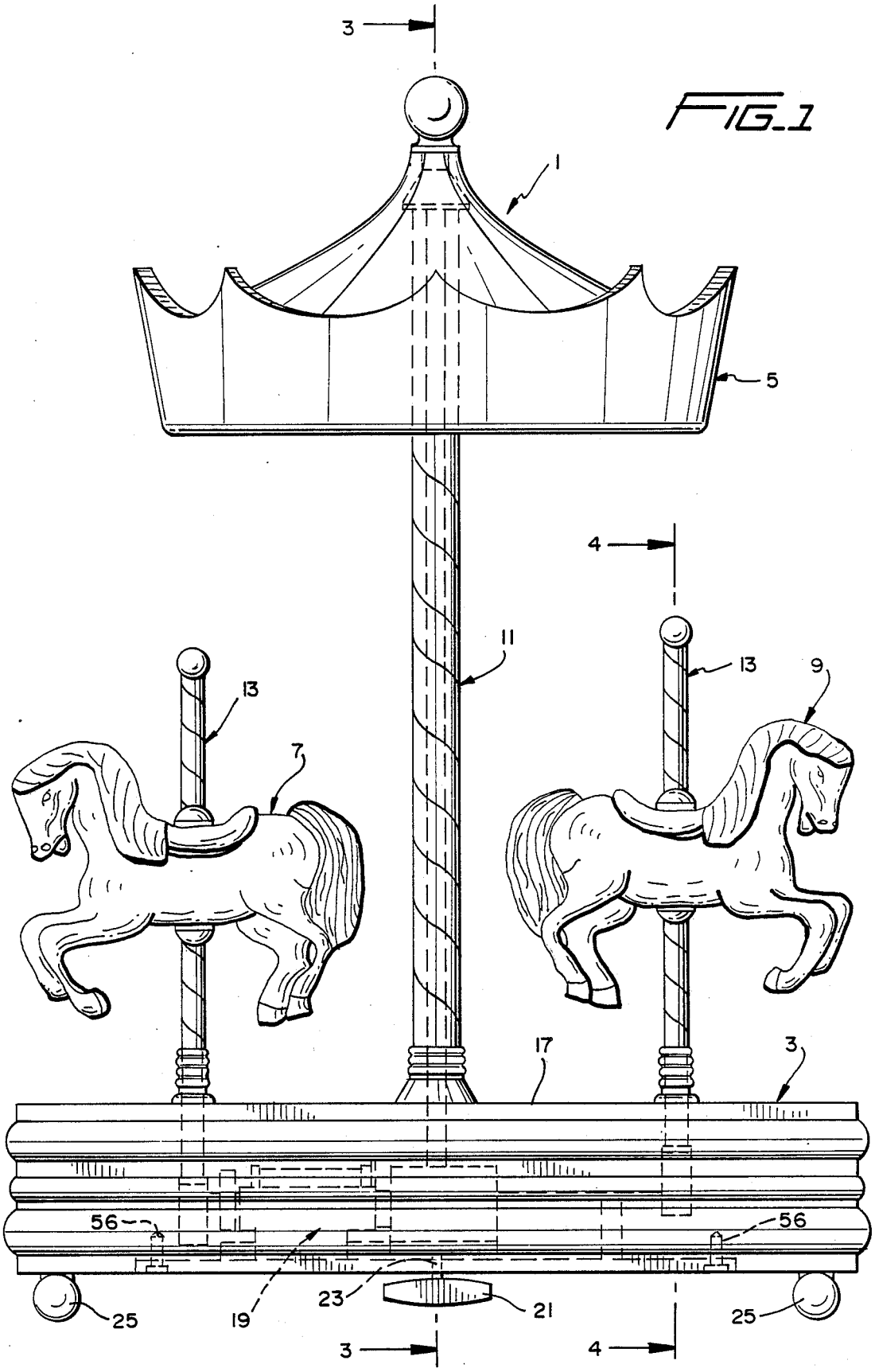
FIG. 1 is a front elevational view of an ornament assembly according to a preferred embodiment of the invention.

An ornamental display assembly 1 according to a preferred embodiment of the invention shall now be described with initial reference to FIG. 1. As shown therein, assembly 1 includes a base 3 on which a plurality of ornaments 5, 7 and 9 are mounted for movement on a plurality of tappet rod assemblies 11 and 13. Rod assemblies 11 and 13 are supported on an upper surface 17 of base 3 and extend upwardly and downwardly therefrom for disposition in driving engagement with a drive mechanism 19, such as a wind-up music box mechanism, housed within base 3 and shown in dotted lines. Mechanism 19 is of a conventional type containing a main spring which is wound for operation by rotating a key 21 secured to the end of a wind.up shaft 23 which extends downwardly from the bottom of base 3. A plurality of appropriate feet 25 are provided at the bottom of base 3 for the purpose of elevating same and providing clearance for key 21.

Figure 2:
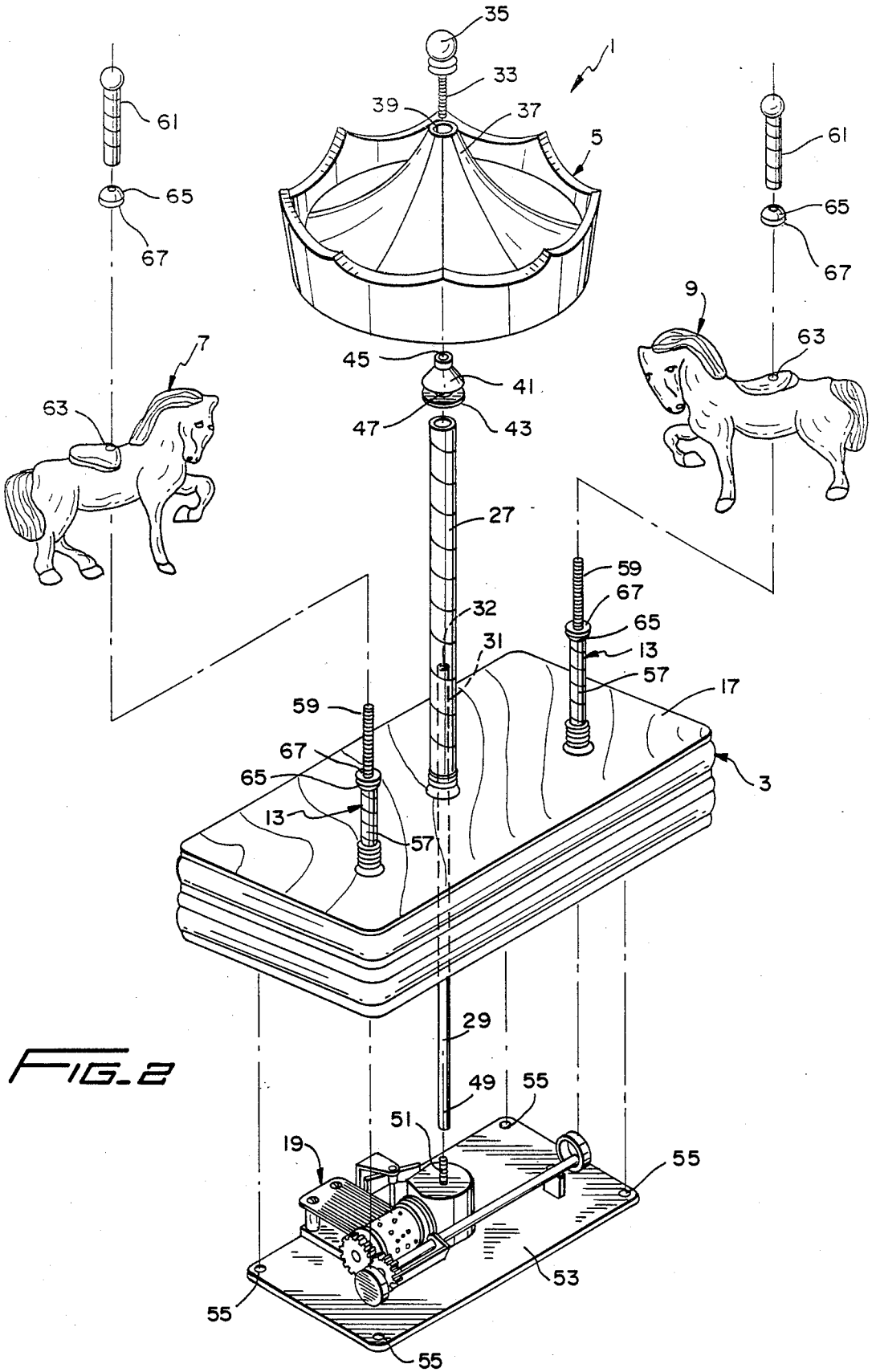
FIG. 2 is an exploded perspective view of the assembly shown in FIG. 1, particularly depicting the manner in which the ornaments are assembled onto the base and wind-up drive mechanism.

Assembly 1 is shown with ornament 5 in the configuration of a canopy, and ornaments 7 and 9 each being in the configuration of a horse. The manner in which ornaments 5, 7 and 9 are assembled onto base 3 shall now be described with reference to FIG. 2. As seen therein, rod assembly 11 for supporting ornament 5 includes a stationary sleeve 27 within which a support rod 29 is rotatably housed. An upper end 31 of rod 29 is provided with an internal threaded passageway 32 for engagement by a threaded stem 33 of a handle 35. The configuration of handle 35 is depicted as essentially spherical, but any other appropriate configuration facilitating manual grasping and rotating by a user may also be utilized. Ornament 5 includes an upwardly tapered central portion 37 provided with an axial opening 39 therethrough for receiving stem 33. A support member 41 and an associated washer 43 are provided for disposition on top of sleeve 27. Member 41 is provided with a central passageway 45 and washer 43 is provided with a central aperture 47, both of which are coaxial and slightly smaller in diameter than the diameter of rod 29 so that upper end 31 may support member 41 and washer 43 thereon. Rod 29 is also provided with an internally threaded lower end 49 for threaded engagement onto a threaded upwardly extending wind.up shaft 51 of mechanism 19, the latter being mounted on a plate 53 which is secured to the bottom of base 3 by a plurality of appropriate mechanical fasteners 56 inserted through a plurality of apertures 55 provided in plate 53, as seen in FIG. 1.

Rod assemblies 13 are of identical structure, but may vary in size, with each including a base portion 57 provided with a threaded stem 59 for attachment to a top portion 61. Ornaments 7 and 9 are each provided with a passageway 63 therethrough for threaded stems 59 therethrough. A decorative cap 65 and washer 67 provided with coaxial apertures may be disposed on opposite sides of passageway 63 and through which stem 59 may also be passed.

Figure 3:
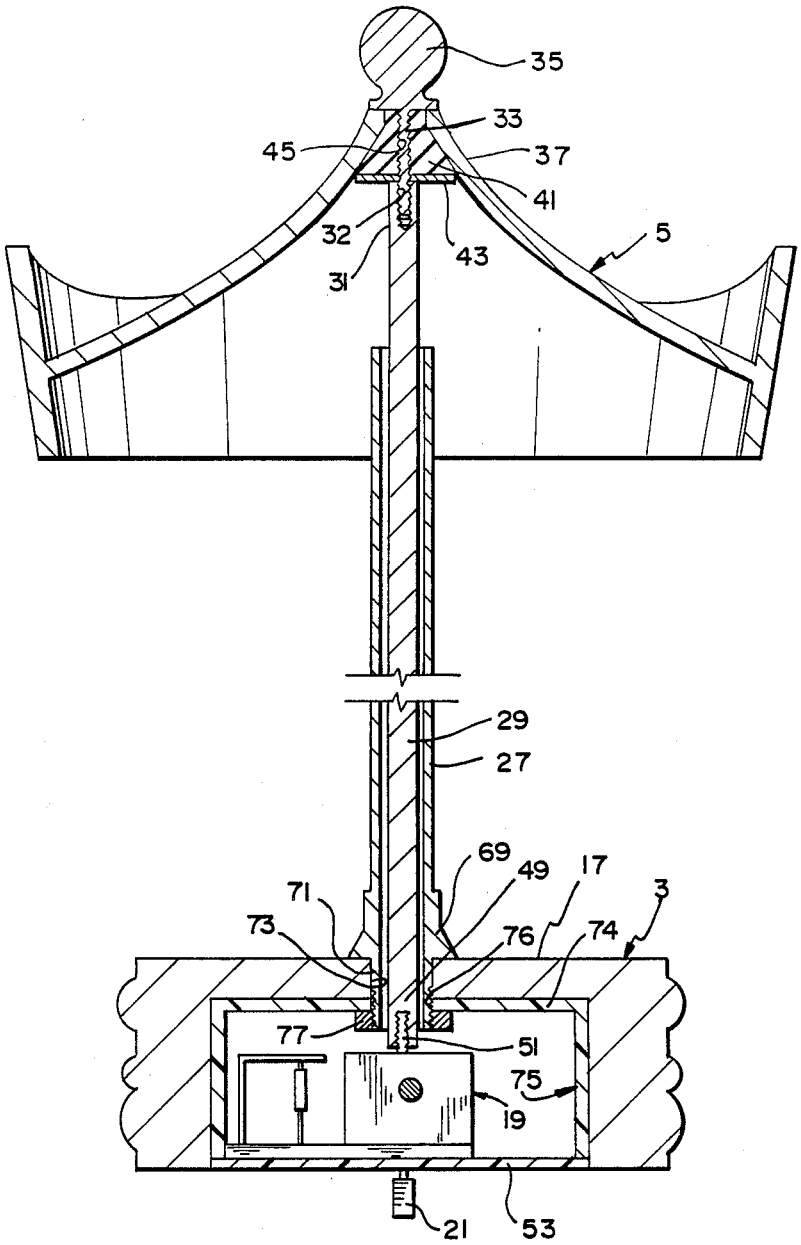
FIG. 3 is a cross sectional view taken along the line 3—3 of FIG. 1 and in partially reduced form to show the manner in which a canopy ornament is supported on a tappet rod assembly and disposed in engagement with the wind-up shaft of the drive mechanism.

The particular details of the manner in which ornament 5 is disposed in driving engagement with mechanism 19 through rod assembly 11 shall now be described with particular reference to FIG. 3. As seen therein, threaded stem 33 of handle 35 is secured within upper end 31 of rod 29, with support member 41 and washer 43 being disposed between rod 29 and handle 35. Member 41 is of a substantially conical configuration and conforms to a correspondingly configured interior wall of upper portion 37. Thus, rod 29, ornament 5 and handle 35 are rigidly secured together as a unit so that ornament 5 may be rotated by a user rotating handle 35, to thereby cause a corresponding rotation of rod 29. Since lower end 49 of rod 29 is threadedly engaged onto wind-up shaft 51, rotation of rod 29 about its longitudinal axis in a given direction, i.e. clockwise, shall cause the main spring of mechanism 19 to be wound in the same manner as if key 21 is rotated. Upon release of handle 35 by the user, rod 29 is caused to rotate about its longitudinal axis in the opposite direction. i.e. counterclockwise, thereby causing ornament 5 to rotate in the same direction. As also seen in FIG. 3, sleeve 27 is provided with a flared portion 69 which engages upper surface 17 of base 3. Sleeve 27 terminates in a threaded end 71 which extends through a passageway 73 formed in base 3 and an aperture 76 formed in an upper wall 74 of a housing 75, and is secured in place by means of a threaded nut 77. Plate 53 forms the bottom of housing 75, the latter being disposed within base 3 and houses mechanism 19.

Figure 4:
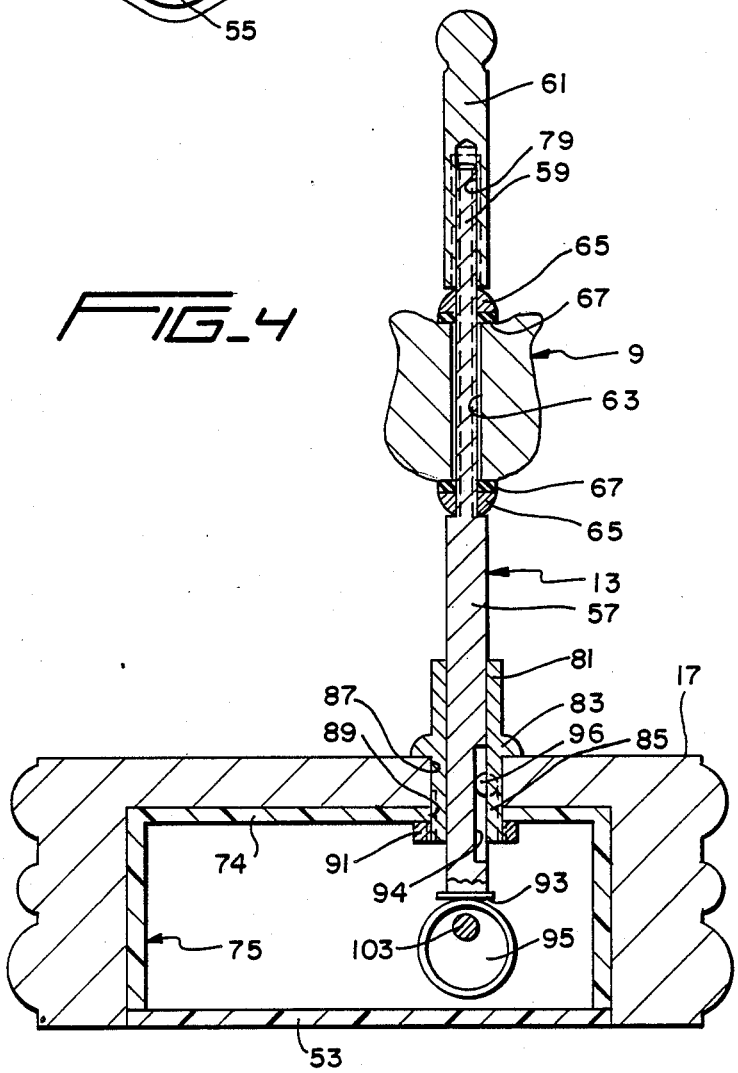
FIG. 4 is a cross sectional view taken along the line 4—4 of FIG. 1 and particularly depicting the manner in which an ornament is supported on a tappet rod assembly that is vertically reciprocated by an eccentric cam member driven by the drive mechanism.

The details of each rod assembly 13 for supporting ornaments 7 and 9 shall now be described with particular reference to FIG. 4. As previously indicated, each rod assembly 13 is defined by base portion 57 and top portion 61. An internal threaded passageway 79 is provided in top portion 61 for engagement on threaded stem 59 after ornament 9 has been mounted thereon. This same arrangement shall of course apply for rod assembly 13 of ornament 7. Base portion 57 is slidably received within a sleeve journal 81 provided with a flared portion 83 and a threaded end 85. Journal 81 is secured to base 3 by inserting threaded end 85 through a passageway 87 formed therein until flared portion 83 is in engagement with upper surface 17. End 85 also extends through an aperture 89 of upper wall 77 and is secured in place by a threaded nut 91. The terminal end of base portion 57 is provided with an end cap 93 which may be secured thereto in any appropriate manner. Base portion 57 also includes a longitudinal groove 94 within which an inwardly extending projection 96 carried by journal 81 is slidably disposed for guiding the vertical movement of rod assembly 13. As also shown in FIG. 4, cap 93 is in engagement with a cam member 95 which causes rod assembly 13 to reciprocate vertically within sleeve journal 81 in a manner which shall hereinafter be described.

Figure 5:
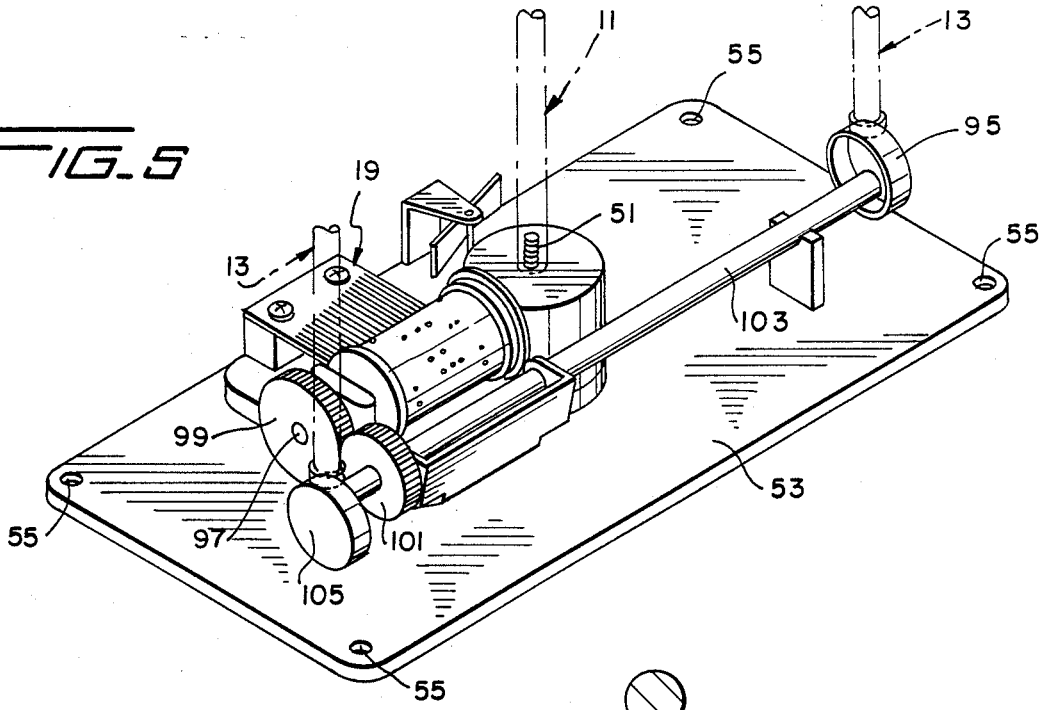
FIG. 5 is a perspective view showing the drive mechanism with three associated tappet rod assemblies, shown in phantom lines, in engagement therewith for imparting rotational and reciprocating movements to three ornaments.

As more particularly shown in FIG. 5, mechanism 19, in addition to being provided with wind.up shaft 51, also includes a power output shaft 97 provided with a first gear 99 that is disposed in meshed driving engagement with a second gear 101 carried by a horizontal drive shaft 103. Rod assembly 13 of ornament 9 is engaged by cam member 95, as previously shown in FIG. 4, while rod assembly 13 of ornament 7 is engaged by a cam member 105. Cam members 95 and 105 are each eccentrically mounted and disposed in an 180° offset configuration on opposite ends of drive shaft 103. Thus, as depicted in FIG. 5, cam member 95 disposes its rod assembly 13 in its uppermost position while cam member 105 disposes its rod assembly 13 in its lowermost position. Rotation of drive shaft 103 shall therefore alternatively reciprocate rod assemblies 13 between these uppermost and lowermost positions as with such reciprocation being guided by groove 94 and projection 96 of each assembly 13. It can further be seen that the offset configuration of cam members 95 and 105 permits same to function according to the principle of a lever, i.e. as one rod assembly 13 is being raised, the weight of the other downwardly moving rod assembly 13 assists in the raising of the one assembly 13. This results in an energy saving advantage which is realized during the operation of mechanism 19.

Assembly 1 is operated by rotating handle 35 and ornament 5. This in turn rotates rod 29 and wind.up shaft 51 to wind the main spring of mechanism 19. After the main spring has been fully wound, release of handle 35 permits ornament 5 to rotate slowly in the reverse direction as the main spring unwinds. Simultaneously, operation of mechanism 19 also causes rotation of horizontal drive shaft 103 by power output shaft 97 to vertically reciprocate rod assemblies 13 in an alternate manner and provide corresponding movements to ornaments 7 and 9. If mechanism 19 is also a music box, then music shall accompany the rotational and reciprocating movements of the ornaments to thereby provide an ornamental display which is both visually and aurally pleasing to watch and hear. Since mechanism 19 may be wound while assembly 1 is maintained in its position of display on a support surface, there is minimum probability of causing accidental breakage to the ornaments so that the latter may be formed from delicate and heavy materials, such as ceramic.

Though assembly 1 has been depicted with a rotating ornament 5 in the form of a canopy and two vertically reciprocating ornaments 7 and 9 in the form of horses, it is further possible to vary the number and configurations of ornaments. For example, a single ornament 7 in the form of a horse may be utilized with an ornament 5 in the form of a canopy. Also, ornament 5 may be eliminated and assembly 1 may only comprise a pair of ornaments 7 and 9.

It is to be understood that the forms of the invention herein shown and described are to be taken as preferred embodiments thereof, and that various changes in shape, material, size and arrangement of parts may be resorted to without departing from the spirit of the invention or scope of the subjoined claims.

I claim:

1. An ornament display assembly of the type wherein movement is imparted to at least one ornament by a wind.up drive mechanism having a main spring, which assembly comprises:

(a) a base;

(b) a wind.up drive mechanism including a power output shaft and a wind-up shaft housed within the base;

(c) a first tappet rod assembly including a stationary sleeve extending upwardly from the base and a support rod rotatably housed within the sleeve, the support rod including upper and lower ends;

(d) a first attachment means for securing a first ornament on the upper end of the support rod and permitting the ornament and support rod to rotate together;

(e) the lower end of the support rod being secured to the wind-up shaft whereby rotation of the support rod in one direction causes the mechanism to be wound and unwinding of the mechanism causes the support rod to rotate in the opposite direction;

(f) a second tappet rod assembly slidably mounted on the base and including a second attachment means for securing a second ornament thereon; and (g) a first eccentric cam member driven by the power output shaft of the mechanism for imparting a vertical reciprocating movement to the second tappet rod assembly.

2. The ornament display assembly of claim 1 further including:

(a) a third tappet rod assembly slidably mounted on the base and including a third attachment means for securing a third ornament thereon; and (b) a second eccentric cam member driven by the power output shaft of the mechanism for imparting a vertical reciprocating movement to the third tappet rod assembly.

3. The ornament display assembly of claim 2 further including:

(a) a horizontal drive shaft driven by the power output shaft of the mechanism; and (b) the first and second cam members being mounted on the horizontal drive shaft in an one hundred eighty degree offset configuration for imparting alternating vertical reciprocating movements to the second and third tappet rod assemblies.

4. The ornament display assembly of claim 1 wherein the first attachment means includes:

(a) a handle provided with a threaded stem for insertion through an opening formed in the first ornament;

(b) a support member having a configuration corresponding to the configuration of a portion of the first ornament for engagement therewith; and (c) the upper end of the support rod including a threaded passageway for engagement by the threaded stem of the handle.

5. The ornament display assembly of claim 4 wherein:

(a) the support member is of a substantially conical configuration and formed of a resilient material;

(b) a washer engageable with the support member; and (c) the support member including an axial passageway and the washer including a central aperture, the axial passageway and central aperture being coaxial for receiving the threaded stem of the handle therethrough.

6. The ornament display assembly of claim 1 wherein:

(a) the second tappet assembly includes a base portion and a top portion;

(b) the second attachment means includes a threaded stem carried by the base portion for insertion through a passageway formed in the second ornament; and (c) the top portion includes an internal threaded passageway for engagement with the threaded stem.

7. The ornament display assembly of claim 6 further including:

(a) a sleeve journal secured to the base and including an inwardly extending projection;

(b) the base portion being slidably mounted through the sleeve journal and including a longitudinal groove; and (c) the projection is slidably disposed within the longitudinal groove for guiding the vertical reciprocating movement imparted to the second rod assembly.

8. An ornament display assembly of the type wherein movement is imparted to at least one ornament by a wind-up drive mechanism having a main spring, which assembly comprises:

(a) a base;

(b) a wind-up drive mechanism including a power output shaft and a wind-up shaft housed within the base;

(c) at least one tappet rod assembly slidably mounted on the base and including attachment means for securing an ornament thereto;

(d) the tappet rod assembly including a base portion and at top portion, and the attachment means includes a threaded stem carried by the base portion for insertion through a passageway formed in the ornament, and the top portion includes an internal threaded passageway for engagement with the threaded stem;

(e) a drive shaft driven by the power output shaft of the mechanism; and (f) at least one eccentric cam member mounted on the drive shaft and disposed in engagement with the tappet rod assembly for imparting vertical reciprocating movement to the tappet rod assembly during operation of the drive mechanism.

9. The ornament display assembly of claim 8 further including:

(a) a sleeve journal secured to the base and including an inwardly extending projection;

(b) the base portion of the rod assembly being slidably mounted through the sleeve journal and including a longitudinal groove; and (c) the projection being slidably disposed within the longitudinal groove for guiding the tappet rod assembly.

10. The ornament display assembly of claim 8 further including:

(a) a pair of tappet rod assemblies slidably mounted on the base; and (b) a pair of eccentric cam members mounted on the drive shaft and disposed in engagement with the tappet rod assemblies.

11. The ornament display assembly of claim 10 wherein the cam members are in an 180° offset configuration for imparting alternating vertical reciprocating movements to the tappet rod assemblies.

12. An ornament display assembly of the type wherein movement is imparted to at least one ornament by a wind-up drive mechanism having a main spring, which assembly comprises:

(a) a base;

(b) a wind-up drive mechanism including a power output shaft and a wind-up shaft housed within the base;

(c) a support rod including upper and lower ends;

(d) first attachment means for securing a first ornament on the support rod and permitting the first ornament and support rod to rotate together;

(e) the lower end of the support rod being secured to the wind-up shaft whereby rotation of the support rod in one direction causes the mechanism to be wound and unwinding of the mechanism causes the support rod to rotate in the opposite direction;

(f) a first tappet rod assembly mounted on the base and including a second attachment means for securing a second ornament thereon; and (g) a first eccentric cam member driven by the power output shaft of the drive mechanism for imparting a vertical reciprocating movement to the tappet rod assembly .

13. The ornament display assembly of claim 12 further including:

(a) a second tappet rod assembly mounted on the base and including a third attachment means for securing a third ornament thereon; and (b) a second eccentric cam member driven by the power output shaft of the mechanism for imparting a vertical reciprocating movement to the second tappet rod assembly.

14. The ornament display assembly of claim 13 further including:

(a) a horizontal drive shaft driven by the power output shaft of the mechanism; and (b) the first and second eccentric cam members being mounted on the horizontal drive shaft;

15. The ornament display assembly of claim 14 wherein the first and second cam members are mounted on the horizontal drive shaft in an 180° offset configuration for imparting alternating vertical reciprocating movements to the first and second tappet rod assemblies.

* * * * *